United States Patent [19]

Yamamoto et al.

[11] 4,070,977

[45] Jan. 31, 1978

[54] SEWING MACHINE

[75] Inventors: Kimihiko Yamamoto, Nagoya; Hitoshi Ishikawa, Anjo, both of Japan

[73] Assignee: Aisin Seiki Kabusihki Kaisha, Japan

[21] Appl. No.: 738,380

[22] Filed: Nov. 2, 1976

[51] Int. Cl.[2] ..... D05B 73/02

[52] U.S. Cl. ..... 112/259

[58] Field of Search ..... 112/258, 259, 241, 242, 112/243, 244, 245, 246, 247

[56] References Cited

U.S. PATENT DOCUMENTS

| | | | |
|---|---|---|---|
| 2,390,571 | 12/1945 | Colegrove | 112/258 |
| 3,561,002 | 2/1971 | Robert | 112/241 |
| 3,782,312 | 1/1974 | Kasuga | 112/241 |

*Primary Examiner*—George H. Krizmanich
*Attorney, Agent, or Firm*—Burns, Doane, Swecker & Mathis

[57] ABSTRACT

A sewing machine having the usual type needle thread taking up lever and the path through which the needle thread travels almost unrevealedly nested within a housing defined by the end face of the arm and a cover to be attached for safety purpose and additionally neat appearance purpose. The sewing machine is further characterized by provision of a separator within the housing in parallel with an internal front face of the cover so as to provide the lever with a space of suitable volume for preventing a loop passing through a thread guiding eye of the lever from being fallen off the eye when the lever is on its slackening stroke.

5 Claims, 6 Drawing Figures

SEWING MACHINE

BACKGROUND OF THE INVENTION

This invention relates to a sewing machine and more particularly to a sewing machine in which the needle thread taking up lever is almost nested or housed unrevealedly within a housing defined by the end face of the usual arm and an end cover to be attached to the end face and further the path through which the needle travels is also unrevealedly nested within the arm as much length as possible for safety of the operator and neat appearance purpose.

For attaining such sewing machine, the thread guiding eye at the extremity of the usual needle thread taking up lever is preferred to be of the opened eye type rather than the known small hole type because of readiness in lacing the needle thread within the opened guiding eye and accordingly readiness in threading up the machine free from affection of unapproachableness of the nested lever.

However, a problem exists in providing the slot type guiding eye in the lever, particularly in preventing the needle thread from being fallen off such opened eye by virtue of a ballooning of the travelling needle thread when the lever is on its stroke to slacken the loop of the thread passing through the eye.

While various means have been provided to be fitted with the sewing machine of this character in order to prevent the thread from being fallen off the guiding eye of opened slot type, none of them have proven to be sufficient.

SUMMARY OF THE INVENTION

A principal object of the present invention is to provide a sewing machine having the needle thread taking up lever and the path through which the needle thread travels almost unrevealedly housed within a housing defined by the end face of the arm and a cover to be attached thereto for safety and neat appearance purpose.

Another object of the invention is to provide a sewing machine of this character which is free from affection of the unapproachably nested lever in lacing the needle thread within the thread guiding eye of the lever.

Still further object of the invention is to provide means for preventing the needle thread from being fallen off the eye of the lever on its loop slackening stroke.

Still yet further object of the invention is to provide a path for the needle thread unrevealedly defined as long length as allowable within the housing.

Still yet further object of the invention is to provide means to facilitate threading up of the machine by a series of sequent indications at the guiding eyes of the needle thread in accordance with advancement of the travelling needle thread.

With these objects and others in view, the present invention comprises generally a hollow arm extending from the usual known base upright and then horizontally, a needle bar vertically slidable at the end portion of the arm and carrying at the lower end thereof a thread carrying needle, a needle thread taking up lever having an opened type thread guiding eye, mechanisms for reciprocating vertically the needle bar and for swivelling the taking up lever in synchronism with the needle bar in formation of stitches in the fabric, an end cover to be attached to the end face of the arm for forming a housing therewith, a separator means for defining a space within the housing of suitable volume to allow the taking lever to swivel therewithin and also prevent the needle thread from being fallen off due to a ballooning of the thread passing through the guiding eye of the lever, and a guiding path means for the needle thread unrevealedly nested within the housing for the purpose of safety of the operator and a neat appearance.

DESCRIPTION OF THE PREFERRED EMBODIMENTS

Figure 1:
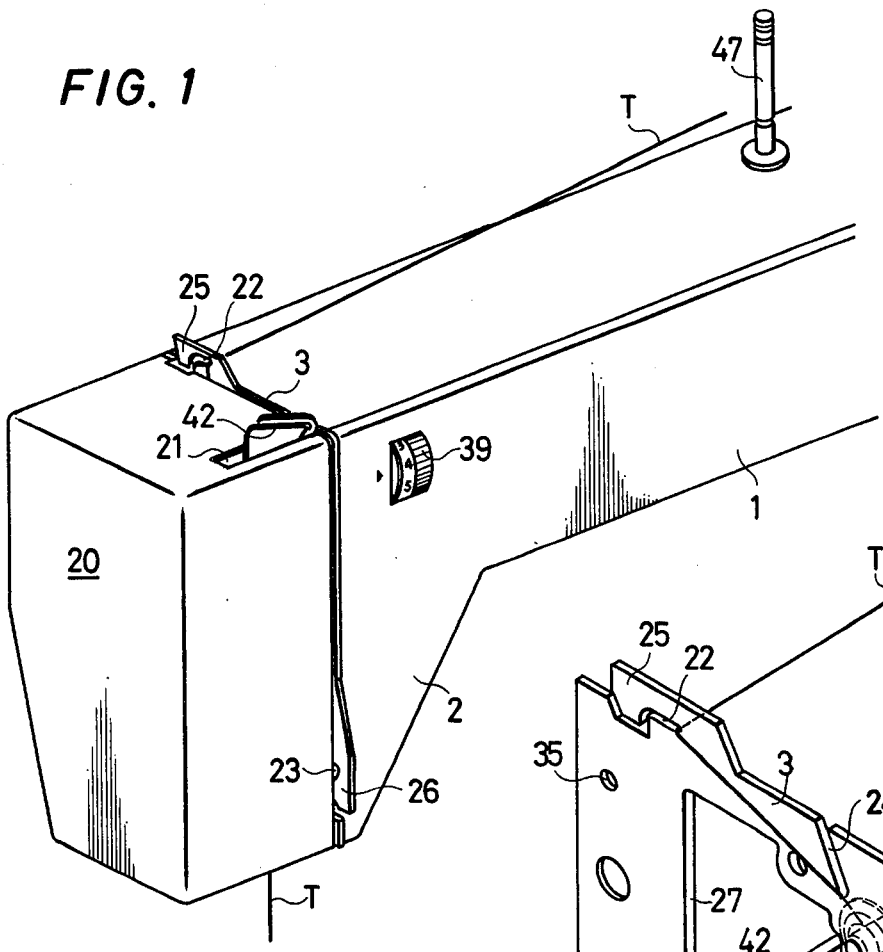
FIG. 1 is a perspective view showing in part a sewing machine according to the present invention.

The present invention is illustrated in the drawings as embodied in the form it may take when applied to a well known and conventional sewing machine and described only insofar as it is believed to be necessary for an understanding of this invention.

Now referring to FIG. 1, such a sewing machine may include a base (not shown) having the usual hollow upright bracket (not shown) extending upwardly therefrom, the hollow arm 1 shown in part in FIG. 1 extends in substantially usual manner over the base to present the end portion or front upright immediately over the usual needle plate (not shown) provided in the base. The end portion of the arm may provide bores or other suitable guides in which may slide presser foot bar 4 and needle thread bar 5 (shown in part) other than means according to the invention. In arm 1 may be positioned a main shaft 6 (shown in part) from which, by the usual mechanism herein described, reciprocating motion is imparted to the needle bar 5. As usual, a pulley (not shown) is attached to the shaft 6 at the end thereof extending outwardly of the arm 1 for association therewith of a belt or other suitable means for driving the machine.

Turning to the mechanism that provides for the usual sewing function of the machine, a counter weight driving crank 7 driven by the rotary arm shaft or main shaft 6 is operatively connected to the needle-bar driving stud 8 by an arm 9. The stud 8 is fast on the needle bar 5 by a set screw 18. The main shaft 6 also drives a needle thread taking up lever 10 through means of a cam 11 secured thereto and adjacent to a lug 12 uprising from the internal face of the wall of the arm 1, for providing therein a bearing of the main shaft 6. The cam 11 is of the known cylinder or barrel type in the body of which is milled a continuous groove 13 being engaged engaged by a roll 14 of the follower lever 10.

Two lugs 15 and 16 uprise from the internal face of the arm 1 so as to secure a stud 17 thereto by means of a set screw 19 for providing the thread taking up lever 10 with a pivot about which may swivel the needle thread taking up lever 10, with its roller 14 engaging the groove 13 in the cam 11.

What has been thus far described is a sewing machine of previously provided structure, as commonly used in the art.

Figure 2:
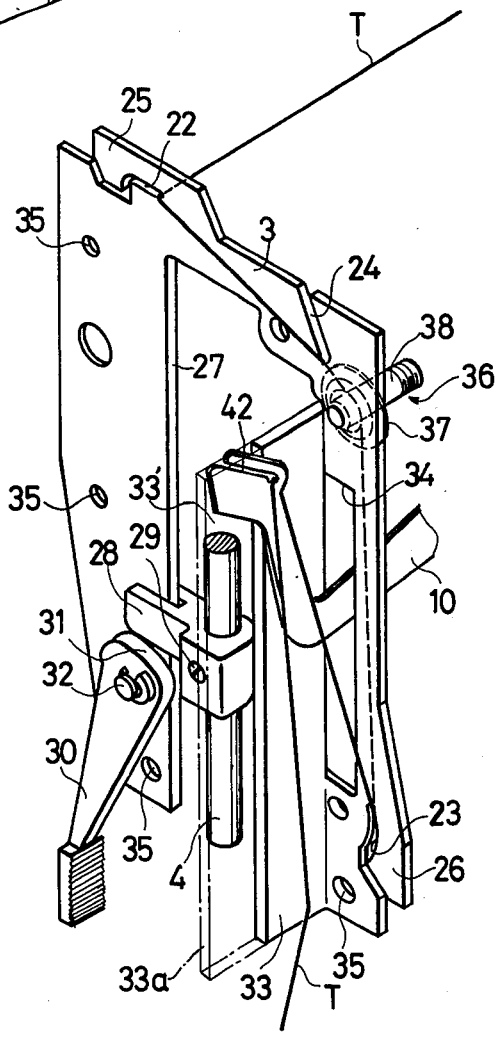
FIG. 2 is a perspective view of parts and mechanisms within a housing formed by the cover and the arm of the sewing machine of FIG. 1.
Figure 3:
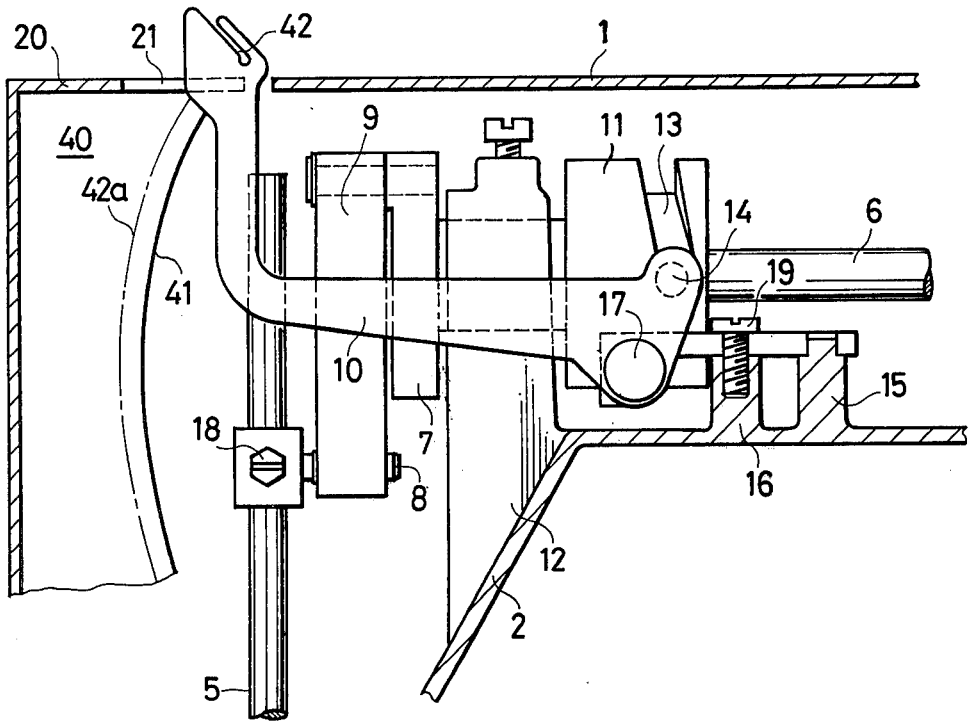
FIG. 3 is an axial cross sectional view of the machine shown in FIG. 1.

The sewing machine of the present invention is further characterized in that, a cover 20 is attached to the end face of the arm 1 in a manner such that the guide plate 3 (FIG. 2) and its associating parts are lamost housed unrevealedly therewithin, so that the needle thread taking up lever 10 is housed in the end cover except that the lever projects its extremity at its uppermost stroke end through a slot 21 in the cover 20 as shown in FIGS. 3 and 1.

As seen in FIG. 2, the guiding plate 3 has an upper thread guiding eye 22 and front guiding eye 23, each being of opened slot type so as to provide an entrance through which the needle thread T is laced within the eyes when the machine is threaded up by the operator, as shown in FIG. 2 in full line. The guiding plate 3 further has a third or middle guiding eye 24 also of opened slot type so as to lace the thread T therewithin. The eyes 22 and 23 either has their rims 25 and 26 protrude outwardly of the end cover 20 as seen in FIG. 1 in order to provide means for lacing the thread T into them when the machine is threaded up.

As will be seen in FIG. 2, the guiding plate 3 is of inverted U-shape and the internal vertical edge 27 is in sliding engagement with a collar 28 fast on the presser bar 4 by means of a set screw 29. A lifting up lever 30 is so pivoted to the guide plate 3 by means of a pin 32 that its cam portion 31 may be within an engagement reach of the collar 28. The presser bar 4 is normally urged downward by the usual spring (not shown) and the presser foot (not shown) carried by the bar at its lowermost end cooperates with usual feed dogs (not shown) to feed the fabric. Of course, the presser foot may be lifted free of the needle plate in the usual manner by upward swinging the lever 30 and cam and bar arrangement of this kind are self-locking against the reversal of the side thrust developed due to the profile of the cam portion 31 when the bar 4 is at the uppermost end of stroke.

As shown in FIG. 2, the guiding plate 3 has a right angled flange 33 at the front side thereof. Such provision is for the sake of mere separation of a space for the lever 10 from the remainder within the cover 20, so that the lever 10 and thread T may be prevented from any dirt.

Adjacent to the flange 33 is an elongated square hole or window 34 through which freely passes the needle thread taking up lever 10. The guide plate 3 is secured to the end face of the arm 1 by means of suitable number of holes 35 in the plate 3 and corresponding number of screws to be threaded into the end face of the arm 1. Ther peripheral profile of the guide plate 3 is identical with that of the end face of the arm 1 as well as the cross section of the cover 20 except that the rims 25 and 26 are slightly projcted outwardly of the end face profile as will be seen in FIG. 1. The guide plate 3 is further provided with a tension device generally designated in FIG. 2 by the numeral 36. The device is shown in this instance in the form of a pair of two washers 37 and threaded rod 38 projecting therethrough. A knurled handle 39 (FIG. 5) engages a nut member (not shown) meshing with the rod 38 and by screwing the nut member by rotating the handle 39 the thread nipping pressure of the washers 37 is determined through a usual coiled spring (not shown) around the rod 38.

The cover 20 is of a opened box form and provided with a separator within its internal space as seen in FIG. 3. The separator 40 is formed of a sheet metal projecting from the internal end face of the cover and an arcuate edge 41 generally concentric with the curvature of path of the eye 42 of the taking up lever 10. The arcuate path **42*a* of the eye 42 is concentric with and diametrically larger than the arcuate edge 41 of the separator 40 as seen in FIG. 3 so that the thread is prevented from being fallen off the eye 42 in the lowering stroke of the lever 10 by an ability of the separator 40 to limit a ballooning of the thread in cooperation with the front internal face of the cover 20**. It has heretofore been known in the art that the thread loop is slackened owing to the abrupt lowering stroke of any thread taking up lever of the type, although the usual feed pick up spring is presented in the passageway to be passed by the thread. The slackened thread loop tends to be formed into a ballooning at the portion passing through the guiding eye of the needle thread taking up lever.

As shown in FIG. 2, the needle thread T is supplied from any suitable spool or other source of supply on a peg 47 which need not be specifically designated here through the upper guiding eye or slot 22, middle eye 24, tension device 36, front guide eye 23, slot type eye 42 at the extremity of the lever 10 to the eye of the thread carrying needle (not shown). As will be seen in FIG. 2, the thread runs along the left side face of the guide 3 between the upper eye 22 and middle eye 24 while running along the right hand side of the guide plate between the tension device 36 and the front eye 23 as shown in dotted line and thereafter restores the left-side location.

Figure 4:
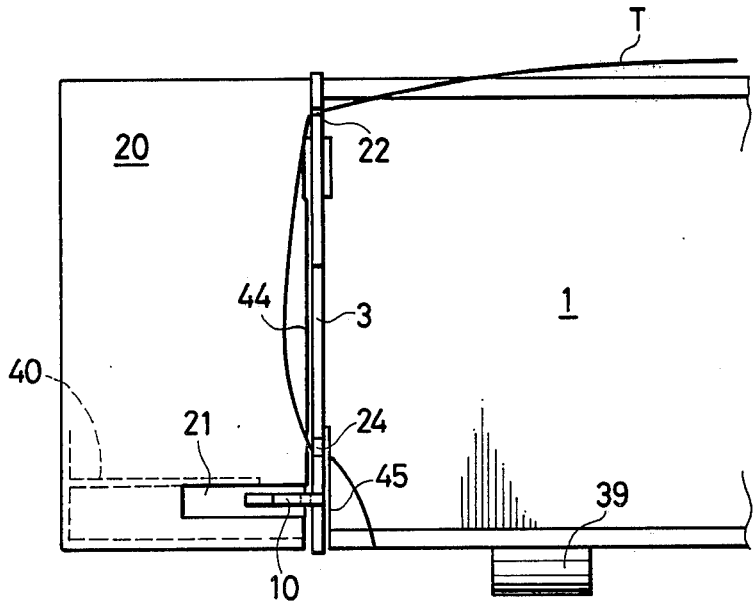
FIG. 4 is a plan view showing in part of the machine shown in FIG. 1.
Figure 5:
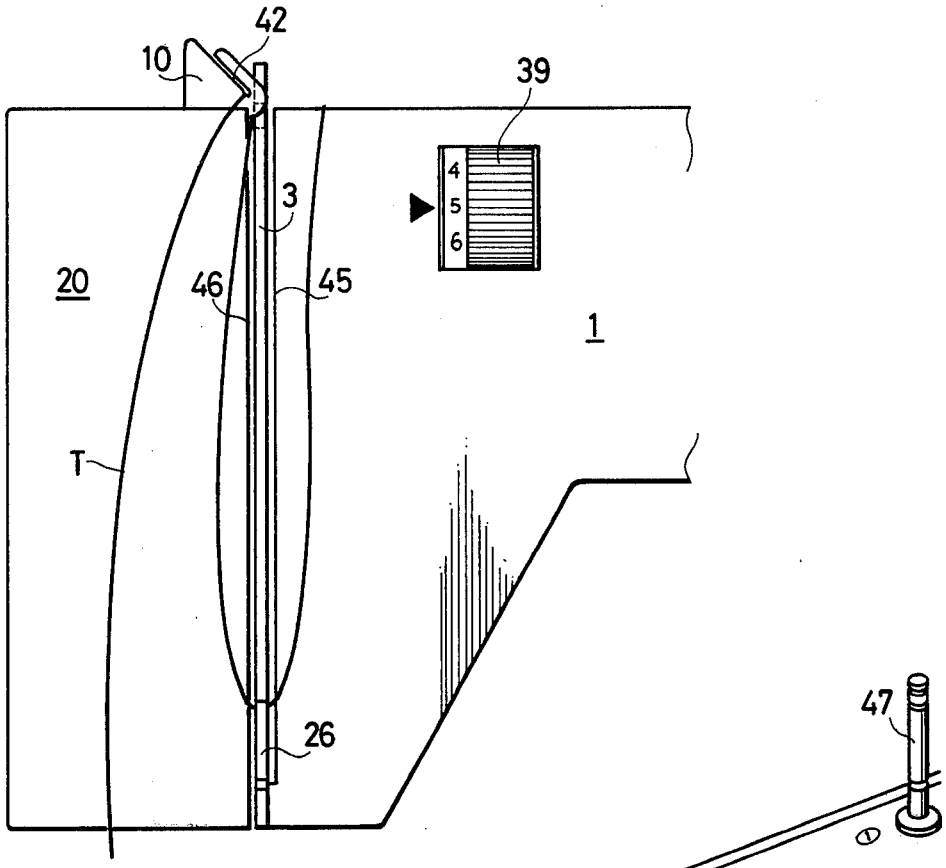
FIG. 5 is an elevational view showing in part the machine shown in FIG. 1.

In order to allow such passageway of the needle thread T, three clearances are formed as designated by the numerals 44 to 46 respectively, in FIGS. 4 and 5. The upper clearance 44 is formed between the left side face of the guide plate 3 and the upper end face of the edge of the cover 20, and clearances 45 and 46 are provided at both sides of the guide plate 3 relative to the end face of the arm 1 and the front edge of the cover 20 respectively as best shown in FIG. 5. In order to ensure such clearances when the cover and guide plate 3 are installed, the end face of the arm 1 and edge of the cover 20 are formed correspondingly with indentations as will be seen in FIGS. 4 and 5.

In threading up the machine, the operator is merely required to have the thread from the supply source pass through the series of guiding eyes along a path shown in thicker full lines in FIGS. 1, 4 and 5 in exaggeratedly slackened condition of the thread, and then required to finally thread the thread carrying needle as usual. Thereafter, by once placing the thread under a sufficient tension, the needle thread is self lacing within all the clearances 44 to 46, so that the threading up of the machine is completed without any conscious effort by the operator.

Instead of the separator 40 of the cover 20, the flange 33 of the guide plate 3 may be enlarged as shown in phantom in FIG. 2 by the numeral 33' so that the needle thread may be prevented from being fallen off the eye 42 of the needle thread taking up lever 10 in the same manner as that practiced by the separator 40. In this embodiment, the vertical edge **33*a* of the flange 33' locates leftwardly of the path 42*a* of the eye 42 (FIG. 3) in order to limit the ballooning of the needle thread passing through the eye 42 when the lever 10** is on its slackening stroke.

Figure 6:
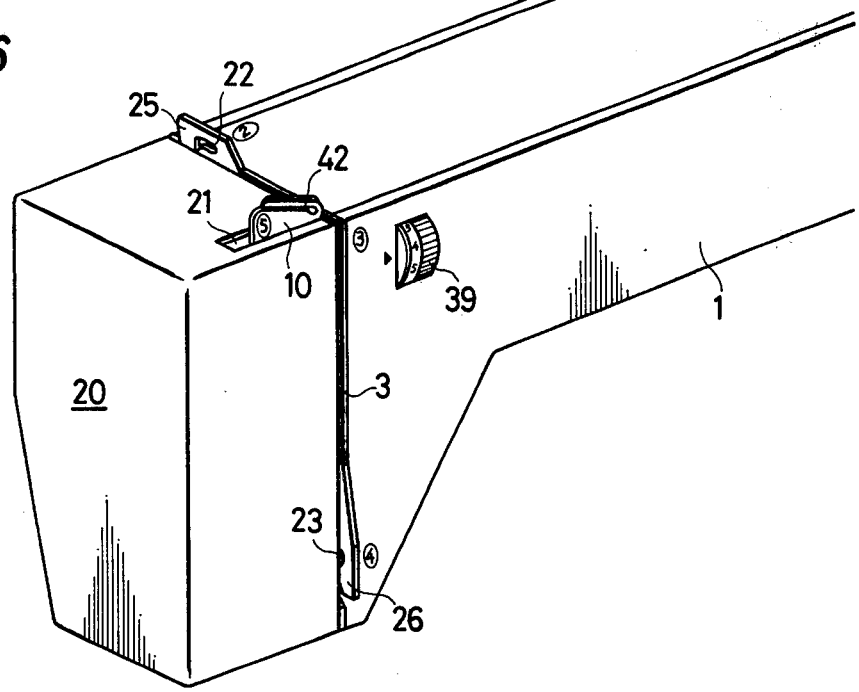
FIG. 6 is a perspective view similar to FIG. 1, showing another embodiment equipped with means to indicate sequence order of thread guiding eyes when the machine is threaded up by the operator.

In order to facilitate to thread up the machine, a series of continuing marks or symbols and the like are provided, in this instance, continuing numbers encircled as shown in FIG. 6, at positions in the face of the arm adjacent to the rod 47 and the three guide eyes 22 to 24.

As described in the foregoing, the machine according to the invention has three principal advantageous features. The first one is that the needle thread taking up lever 10 is unrevealedly nested within the cover 20 so that the operator is normally free from any injury as would otherwise be feared.

The second one is readiness of threading up the machine because of no closed small hole type guiding eye except the thread carrying needle.

The third one is that the threading up of the machine is enabled to be further ready for any one lacking experience by providing a series of sequent marks, such as for example, sequent numerals, at positions adjacent to the corresponding guiding eyes along the path to be traced by the travelling needle thread.

What is claimed is.

1. In a sewing machine comprising a base, a hollow arm extending from the base upright and then horizontally, a needle bar vertically reciprocating at the end portion of the arm and carrying at the end a thread carrying needle, a main driving shaft horizontally extending within said arm, a needle thread taking up lever having a slot type thread guiding eye at the free extremity thereof and being pivotable in a vertical plane parallel to the main driving shaft, a mechanism driven by the main shaft for reciprocating the needle bar and swivelling the needle thread taking up lever in synchronism with the reciprocation of the needle bar for taking up and slackening a loop of the needle thread passing through the slot type thread guiding eye, a cover attached to the end face of the arm for defining a housing in cooperation with the arm so as to nest the needle thread taking up lever in the housing, said cover having an upper side wall and a front side wall and having a small window in the upperside wall thereof elongated in parallel with the main driving shaft to permit the slot type thread guiding eye of the taking up lever to project outside of the cover, a separator means within the cover of sheet metal parallel to the front side wall of the cover to define as a partition wall in cooperation with a front side wall of the cover a space of a volume sufficient to allow the taking up lever to swivel therein but to control a ballooning of a portion of the needle thread passing through the guiding eye of the lever, and path means for the needle thread to travel unrevealedly with the cover.

2. The sewing machine as claimed in claim 1 wherein, said path means includes a sheet form plate attached to the arm at the end face of the arm at right angle to the main shaft and between the cover and the arm, said plate having three slot type needle thread guiding eyes two of which are located on the top side of said sheet form plate and the third of which is located on the bottom front side of the said sheet form plate, said eyes being peripherally congruent with the cross sectional peripheral contour of the end face of the arm to which the plate is attached so as to provide no protrusion outwardly beyond the cross sectional contour of the end face of the arm when installed except that an entrance of each said guiding eye slightly protrudes outside of the cross sectional contour of the end face of the arm to provide ready lacing of the needle thread therewithin, and clearances are formed between the upper leftface of the plate and the corresponding edge of the cover and between the front right face of the plate and the end face of the arm in a manner such that a zigzag passageway is provided for the thread past the three guiding eyes unrevealedly within the housing and the slot type thread guiding eye of the needle thread taking up lever.

3. The sewing machine as claimed in claim 1 wherein said partition wall is a sheet plate extending from an internal end face of the cover in parallel with said front side face of the cover to define said space therebetween.

4. The sewing machine as claimed in claim 2 wherein a series of sequential indications are marked on the arm corresponding to the three guiding eyes of said sheet form plate in accordance with the advancement of the travelling needle thread through the path of the thread.

5. The sewing machine as claimed in claim 3 wherein said partition wall is a sheet plate extending from said sheet form plate of said path means into said cover in parallel with said front side wall of said cover to define said space therebetween.

* * * * *